US005391077A

United States Patent [19]

Rosebeary

[11] Patent Number: 5,391,077

[45] Date of Patent: Feb. 21, 1995

[54] DRUM OVEN

[75] Inventor: Patrick R. Rosebeary, Guthrie, Okla.

[73] Assignee: Kerr-McGee Corporation, Oklahoma City, Okla.

[21] Appl. No.: 172,341

[22] Filed: Dec. 23, 1993

[51] Int. Cl.[6] ..... F27B 3/22

[52] U.S. Cl. ..... 432/176; 432/205

[58] Field of Search ..... 432/175, 176, 205

[56] References Cited

U.S. PATENT DOCUMENTS

| | | | |
|---|---|---|---|
| 2,504,810 | 6/1945 | Dailey . | |
| 3,353,805 | 8/1965 | Grieve . | |
| 3,958,936 | 5/1976 | Knight . | |
| 4,460,332 | 7/1984 | Lawler et al. . | |
| 4,597,736 | 7/1986 | Moffat . | |
| 4,699,119 | 10/1987 | Benko et al. . | |
| 4,836,776 | 6/1989 | Jomain | 432/176 |
| 4,854,863 | 8/1989 | Hemsath | 432/205 |
| 4,909,732 | 3/1990 | Wingens | 432/176 |
| 5,185,126 | 2/1993 | Adamski et al. . | |
| 5,207,573 | 5/1993 | Miyagi et al. | 432/205 |
| 5,290,189 | 3/1994 | Hemsath et al. | 432/205 |

*Primary Examiner*—Henry C. Yuen
*Attorney, Agent, or Firm*—Herbert M. Hanegan

[57] ABSTRACT

The invention discloses a simply designed oven which uses forced air convection as a heating mechanism. One or more drums can be installed in the oven over a catch basin of sufficient volume to include the contents of at least one drum. A gear or similar pump is provided to agitate the contents, as well as to perform the pump-out feature. An inert gas blanketing system is provided for each drum so that additional inert gas is supplied to replace the contents being pumped out of the drum while excess vapors created from the warming process, which could ignite if placed adjacent an ignition source, can be piped to a safe place remote from the oven interior.

4 Claims, 2 Drawing Sheets

DRUM OVEN

FIELD OF THE INVENTION

The field of this invention relates to warming ovens, particularly those that can be used for drums.

BACKGROUND OF THE INVENTION

In the past, oven designs of many types have been in use for a variety of purposes. Typically, these have been insulated enclosures with the ability to add heat through a heating element or other heat source. Some of these designs have employed fans to circulate the air internally. Others, particularly those used for heating semiconductor wafers, employ a feature of evacuation of the oven prior to release of preheated nitrogen into the oven. Such application is shown in U.S. Pat. No. 4,597,736. Other types of ovens which illustrate the use of heating elements and fans are U.S. Pat. Nos. 5,185,126; 4,460,332; 3,353,805; 3,958,936; and 2,504,810. U.S. Pat. No. 4,699,119 illustrates a heating cabinet which is portable for use in warming drums. A steam coil is provided along the bottom, below a support grating for the drums. A catch basin is provided in the enclosure which is open through the wall of the oven to provide not only drainage but also an outlet for any pressure that may accumulate within the enclosure.

These prior designs do not address unique situations involving highly viscous fluids which can emit flammable vapors when sufficiently heated to reduce their viscosity to a point where they can be easily pumped for further use in other processes. What has been lacking in prior art is a simply designed oven which takes into account the need to simultaneously warm, agitate and pump out containers such as drums while they are being heated, while at the same time paying particular attention to the safety aspects involved in dealing with vapors that can be emitted during the warming procedure.

SUMMARY OF THE INVENTION

The invention discloses a simply designed oven which uses forced air convection as a heating mechanism. One or more drums can be installed in the oven over a catch basin of sufficient volume to include the contents of at least one drum. A gear or similar pump is provided to agitate the contents, as well as to perform the pump-out feature. An inert gas blanketing system is provided for each drum so that additional inert gas is supplied to replace the contents being pumped out of the drum while excess vapors created from the warming process, which could ignite if placed adjacent an ignition source, can be piped to a safe place remote from the oven interior.

DETAILED DESCRIPTION OF THE PREFERRED EMBODIMENT

Figure 1:
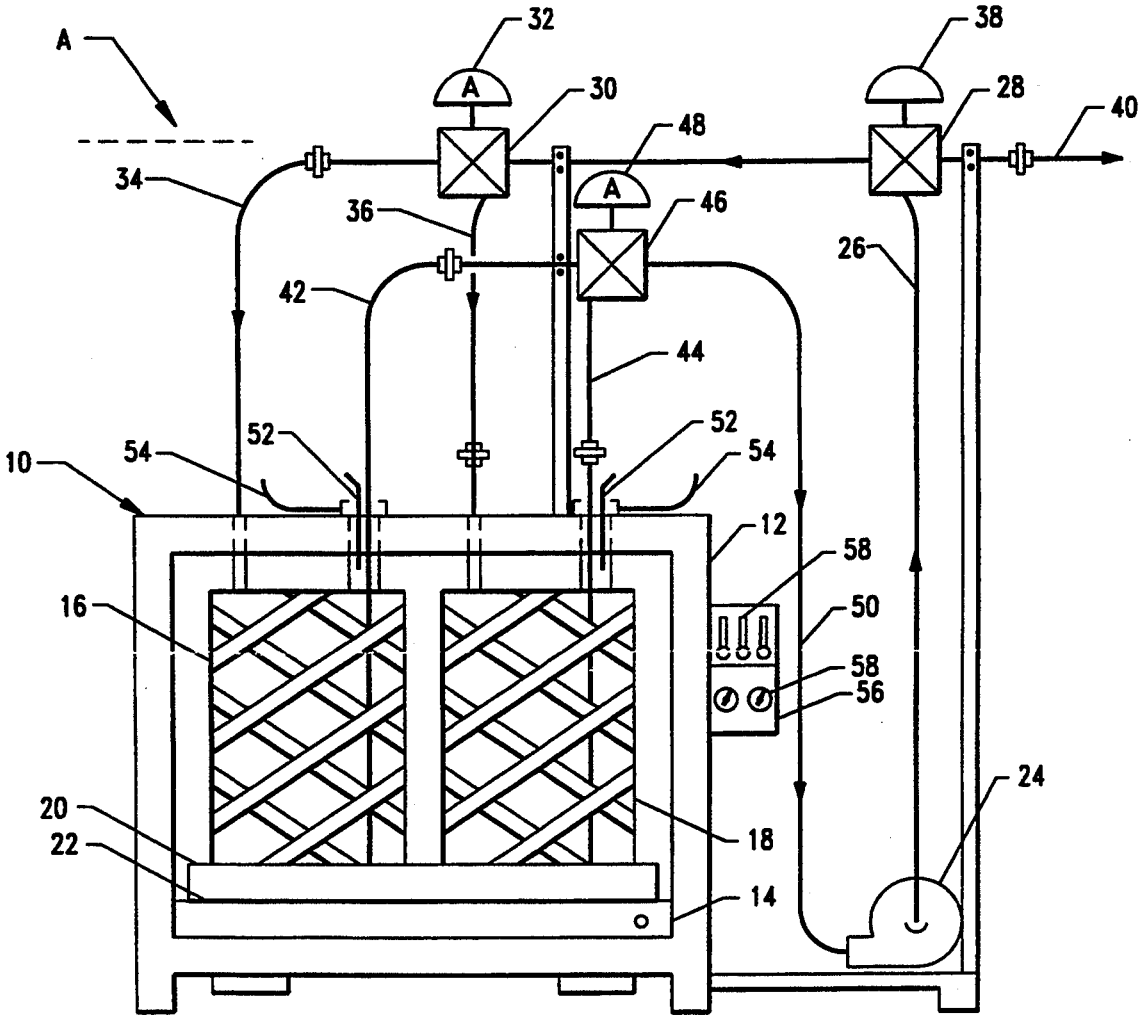
FIG. 1 is a schematic representation of the utilities provided to the oven of the present invention, as well as a depiction in sectional elevation of the oven enclosure.

The oven 10 is shown in FIG. 1. Oven 10 comprises of an insulated housing 12, which has a front door, not shown in the section view of FIG. 1 for clarity. Within the housing 12 is a catch basin 14, which has an outlet 74. A valve (not shown) can be placed in outlet 74 so as to selectively allow any spillage from any drum 16 or 18 placed in the oven to be directed to a safe location at an appropriate time. The drums 16 and 18 are placed in the oven on a pallet 20, which is in turn preferably supported from a grating 22 which lies above the catch basin 14. The capacity of catch basin 14 is preferably at least the volume of one of the drums. The housing 12 can be designed to accommodate two drums 16 and 18, as shown in FIG. 1, or more drums or only one drum, depending on the application.

Associated with the oven 10 is a circulating pump 24 which is connected through a discharge line 26 to a three-way valve 28. Three-way valve 28 is actuated by an actuator 38 to direct the flow from pump 24 either to further processing, as indicated by line 40, or to three-way valve 30, which is also actuator-operated via actuator 32. The flow coming to three-way valve 30 can be directed selectively to either line 34 or line 36 or to both simultaneously if drums 16 and 18 contain the same material. More than one pump 24 and related piping system can be used if different materials are required to be heated simultaneously without cross-contamination. However, if the material in drums 16 and 18 is identical, the contents of each drum can be recirculated during the heating operation by operating a single pump 24. Pump 24 maintains suction out of drums 16 and 18 through lines 42 and 44. When those lines are aligned to pump 24 through three-way valve 46, pump 24 can take the contents out of drums 16 and 18 and recirculate them either back to the same drums or to further processing through line 40, depending on the position of three-way valve 28.

When the contents of the drums 16 and 18 are sufficiently heated, pump 24 is used to empty the drums for further processing. The act of pumping out the drums 16 and 18 tends to reduce the pressure in those drums. To make up for the volume pumped out of drums 16 and 18, a source of inert gas (preferably nitrogen) is connected to each drum, as shown schematically by the numeral 52 in FIG. 1. The pressure of the blanketing nitrogen is regulated to a very low quantity in the range of a few inches of water pressure. The flow is regulated through a pressure regulator of a type well-known in the art which senses the drum internal pressure and either regulates the flow of nitrogen into each drum through the supply line 52 or, alternatively, if pressure is building in the drum from increased vapor pressure due to the drum's heating, the regulator acts to vent nitrogen and potentially flammable vapors through a vent system schematically shown as 54 in FIG. 1. The vent system 54 has an outlet, preferably outside of any building in which the oven 10 is located, so that the likelihood of contact with an ignition source is reduced, if not eliminated.

It can readily be seen that pump 24 provides agitation during the heating of the drums 16 and 18, thereby improving the rate of heat transfer and allowing the drums to be warmed more quickly. Pump 24 is of a type especially suited for pumping very viscous fluids, such as a gear pump.

As an alternative to the pressure-regulated system for the blanketing gas for the drums 16 and 18, a continuous purge system can also be used. Flow meters such as flow tubes 58 can be used for a visual indication of the rate of nitrogen addition into each drum. Under this system, the nitrogen would be added in the point as shown schematically as numeral 52 in FIG. 1, and continuously vented through the venting system shown schematically as numeral 54. A separate flow meter 58 can be used to regulate the flow to each drum. A control panel 56 can be used which also includes not only flow indicators 58 for the purge gas, but also pressure indicators to allow the operator to sense the pressure in each of the drums 16 and 18 during the warming cycle.

Figure 2:
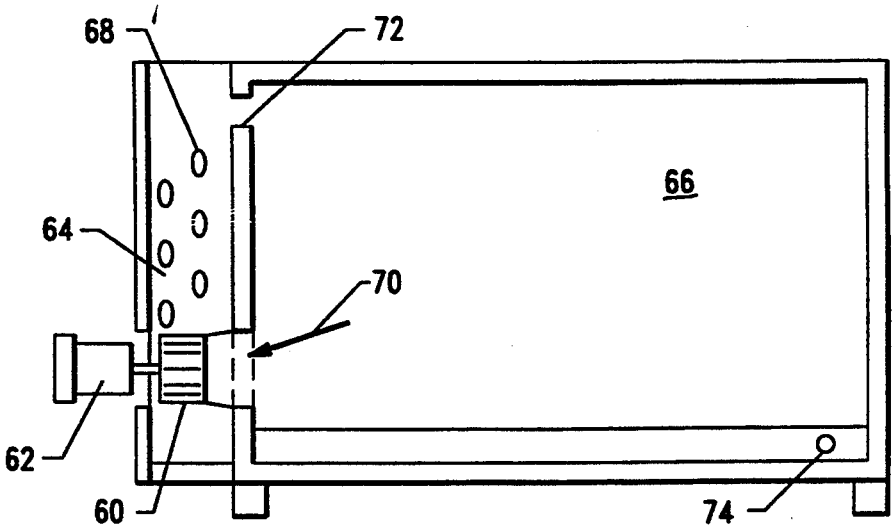
FIG. 2 is a sectional elevational view through the oven enclosure, illustrating the circulating fan and heating elements.
Figure 3:
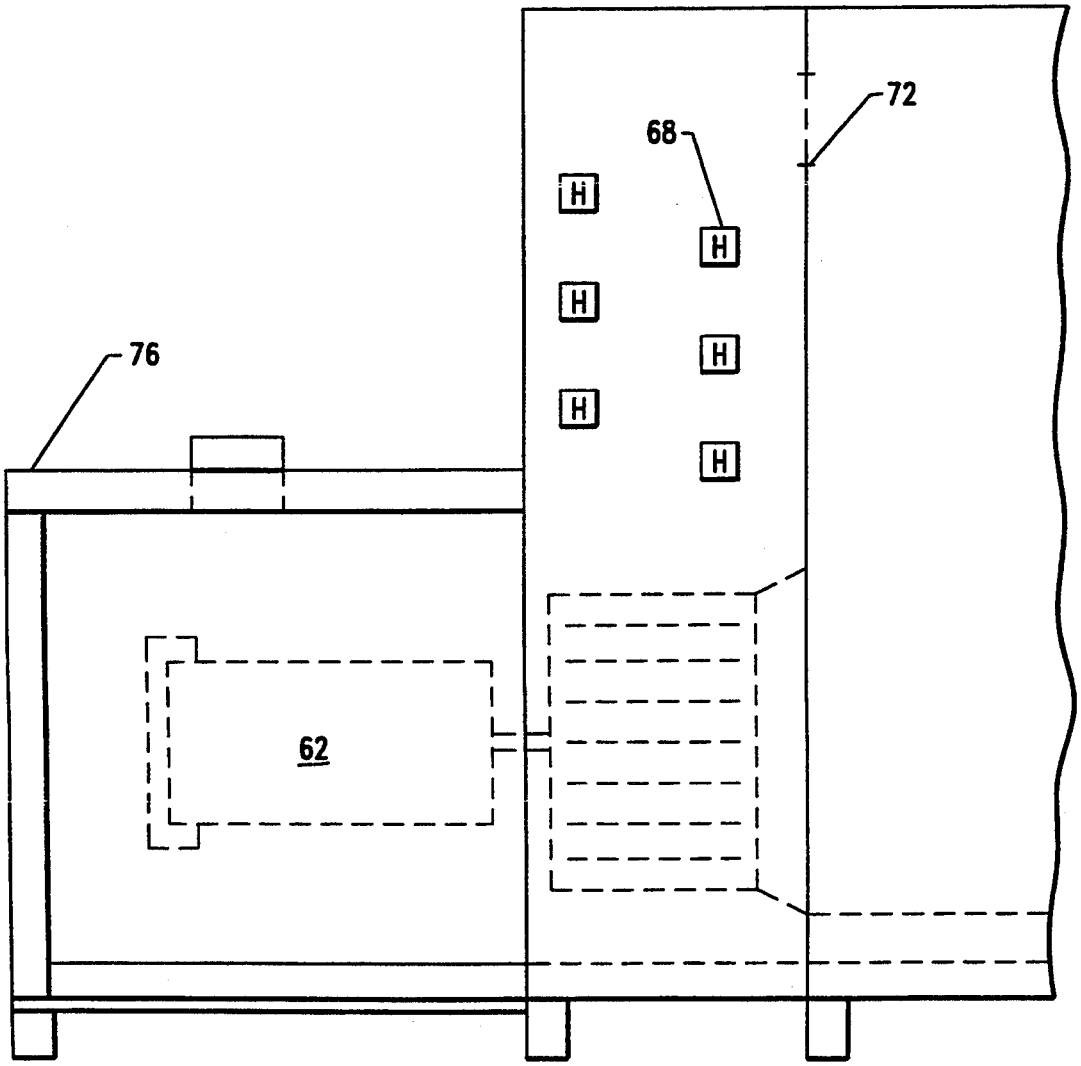
FIG. 3 is another view of the circulating fan and its motor driver, illustrating the housing around the fan and driver.

FIGS. 2 and 3 illustrate some of the construction features of the oven 10 of the present invention with regard to the forced circulation. A blower 60, driven by a motor 62, has its suction 70 aligned with compartment 66, which is the compartment that would house drums 16 and 18. The discharge of blower 60 is in a separate compartment 64. Heating elements, which can be fin tube units with steam provided thereto or electric heating elements or any other type of heat source, are disposed in compartment 64. An opening 72 connects compartment 64 to compartment 66. As a result, when motor 62 is operated, return air comes back into blower 60 through suction 70 and is reheated over heating element 68 to be discharged back into compartment 66 through opening 72. As seen in FIG. 3, there is an insulated enclosure for the blower motor 62. In the preferred embodiment, the blower motor and all other electrical components in the vicinity of the oven 10 are rated class 1, division 2, thereby providing additional insurance that any flammable gas will not come into contact with any arcing or source of any spark.

As previously stated, any spills that go through the grating 22 are collected in catch basin 14 to be selectively released to a safe enclosure for proper disposal or further processing after passing through outlet 74.

The entire oven 10 assembly, including the utilities such as the pump 24 and flow indicators 58, can be mounted on a unitary skid so that oven 10 can be easily transported for use in various locations after the necessary power and utility connections are made.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for heating material stored in at least one container, comprising:

a housing;

a heater mounted to said housing;

a venting system in fluid communication with a container in said housing to facilitate movement of vapors with respect to said container to a point removed from said housing while said container is being heated;

a pumping system for moving the contents of said container while placed in said housing, said pumping system comprising at least one circulating pump and piping connecting said pump to and from said container placed in said housing; and a control system to direct flow from said pump to recirculate to said container in said housing or to transfer the contents of said container to a point outside of said housing.

2. The apparatus of claim 1, wherein said venting system further comprises:

at least one port for an inert fluid;

a regulating system connecting to said port to control internal container pressure by selectively adding an inert fluid or venting pressure build-up within said container to a safe location outside of said housing;

a vent line extending through said housing connectible to a container for conducting any ignitable vapors to a safe location away from said housing; and said regulating system further comprising a pressure vacuum regulator capable of allowing gas to enter to prevent vacuum and to add gas to maintain a preset pressure in a container or containers.

3. The apparatus of claim 2, wherein said regulating system further comprises:

at least one flow controller operably connected to said port for providing a purge flow to said container.

4. The apparatus of claim 2, further comprising:

a circulation device to recirculate fluid, found within said housing and outside of said container, over said heater;

said heater and said circulation device mounted in an adjacent compartment to said housing.

* * * * *